US010439366B2

(12) United States Patent
Sakai et al.

(10) Patent No.: US 10,439,366 B2
(45) Date of Patent: Oct. 8, 2019

(54) DISCHARGE TUBE HAVING DISCHARGE ACTIVE LAYER(S)

(71) Applicant: MITSUBISHI MATERIALS CORPORATION, Tokyo (JP)

(72) Inventors: Shinji Sakai, Naka (JP); Yoshitaka Mayuzumi, Naka (JP); Ryoichi Sugimoto, Naka (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 15/765,812

(22) PCT Filed: Sep. 23, 2016

(86) PCT No.: PCT/JP2016/004321
§ 371 (c)(1),
(2) Date: Apr. 4, 2018

(87) PCT Pub. No.: WO2017/061078
PCT Pub. Date: Apr. 13, 2017

(65) Prior Publication Data

US 2018/0301876 A1 Oct. 18, 2018

(30) Foreign Application Priority Data

Oct. 9, 2015 (JP) ..... 2015-200661

(51) Int. Cl.
*H01T 2/02* (2006.01)
*H01T 1/22* (2006.01)
(Continued)

(52) U.S. Cl.
CPC ..... *H01T 2/02* (2013.01); *H01T 1/22* (2013.01); *H01T 4/12* (2013.01); *H01T 1/20* (2013.01)

(58) Field of Classification Search
CPC ..... H01T 2/02; H01T 1/22; H01T 4/12
See application file for complete search history.

(56) References Cited

U.S. PATENT DOCUMENTS 4,104,693 A 8/1978 Toda et al.
5,235,247 A * 8/1993 Shishido ..... H01J 9/245 313/325
(Continued)

FOREIGN PATENT DOCUMENTS

JP 60-38491 U 3/1985
JP 61-281489 A 12/1986
(Continued)

OTHER PUBLICATIONS

International Search Report dated Nov. 29, 2016, issued for PCT/JP2016/004321 and English translation thereof.
(Continued)

*Primary Examiner* — Tracie Y Green
(74) *Attorney, Agent, or Firm* — Locke Lord LLP

(57) ABSTRACT

To provide a discharge tube having improved stability of operating voltage to repeated discharges. The discharge tube includes a cylindrical insulating hollow body having openings at least at both ends and at least a pair of sealing electrodes facing to each other for closing the openings so as to seal a discharge control gas inside the body, wherein a discharge trigger film made of a conductive material is formed on the inner circumferential surface of the insulating hollow body, each of the sealing electrodes has a convex portion projecting into the insulating hollow body and a discharge active layer(s) that is/are made of a material having higher electron emission characteristics than that of the sealing electrodes.

3 Claims, 6 Drawing Sheets

(51) Int. Cl.
*H01T 4/12* (2006.01)
*H01T 1/20* (2006.01)

(56) References Cited

U.S. PATENT DOCUMENTS

| | | | | |
|---|---|---|---|---|
| 8,227,989 | B2 * | 7/2012 | Kim | H01T 2/02 313/234 |
| 2006/0209485 | A1 * | 9/2006 | Imai | H01J 17/20 361/120 |

FOREIGN PATENT DOCUMENTS

| | | | |
|---|---|---|---|
| JP | 2000-12186 | A | 1/2000 |
| JP | 3125264 | U | 9/2006 |
| JP | 3140979 | U | 4/2008 |
| JP | 2012-155882 | A | 8/2012 |
| JP | 5707533 | B2 | 4/2015 |
| WO | 2015/151385 | A1 | 10/2015 |

OTHER PUBLICATIONS

Supplementary European Search Report dated Apr. 16, 2019, issued for the European Patent Application No. 16853237.2.

* cited by examiner

[FIG.1]
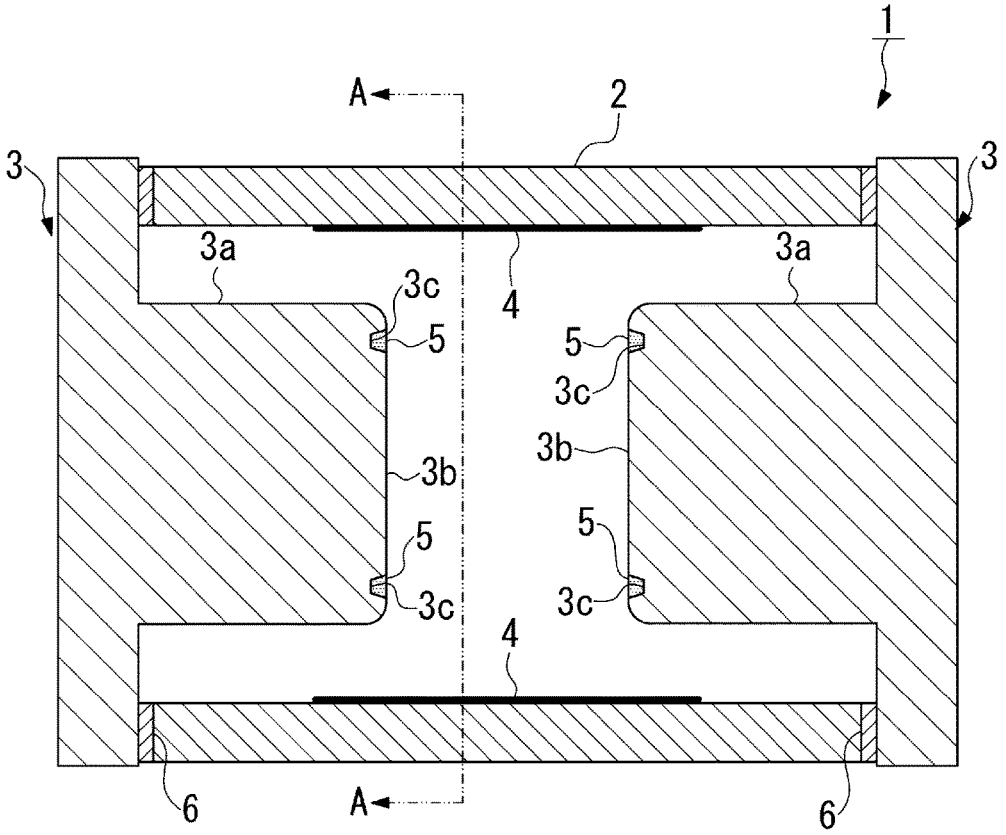

[FIG. 2]
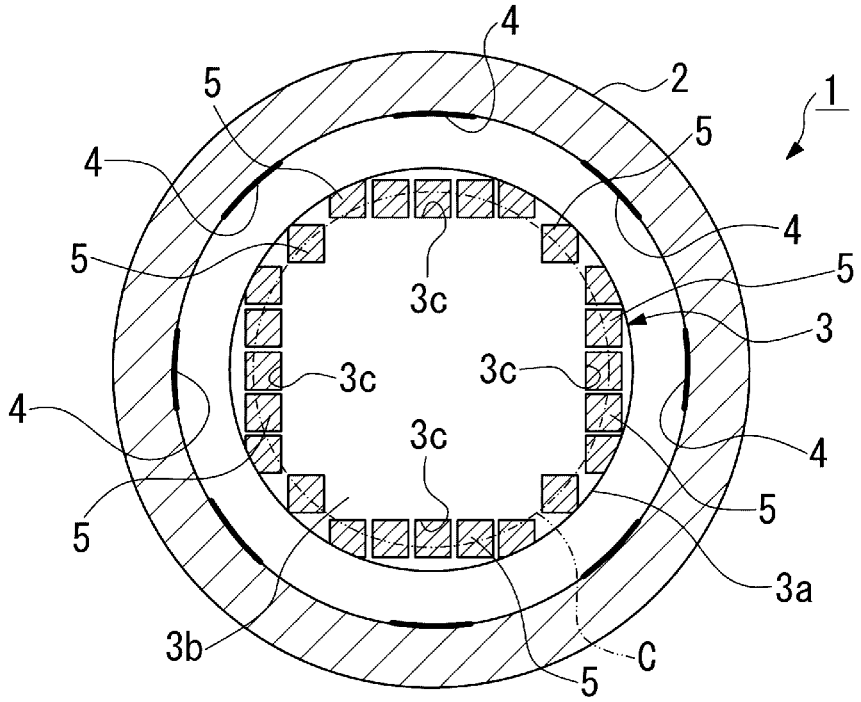

[FIG.3]
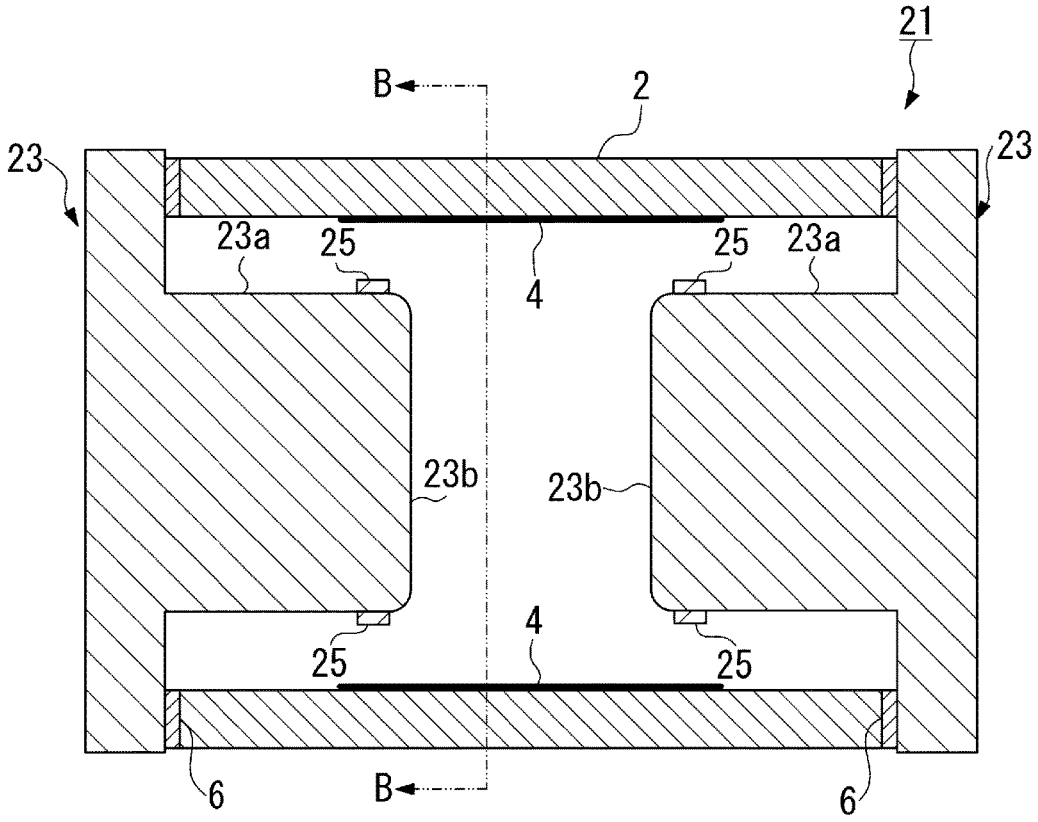

[FIG.4]
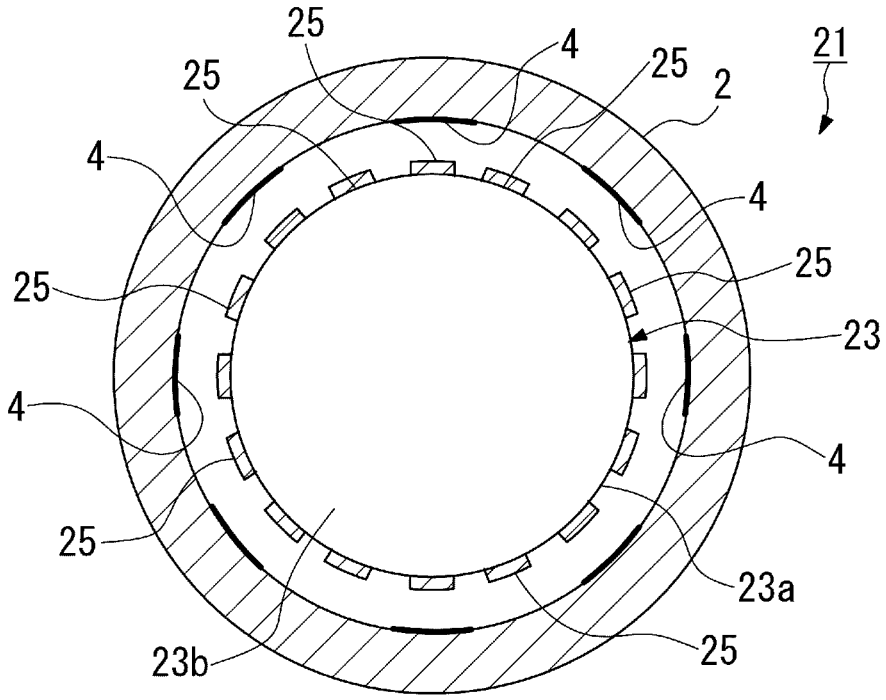
[FIG.5]
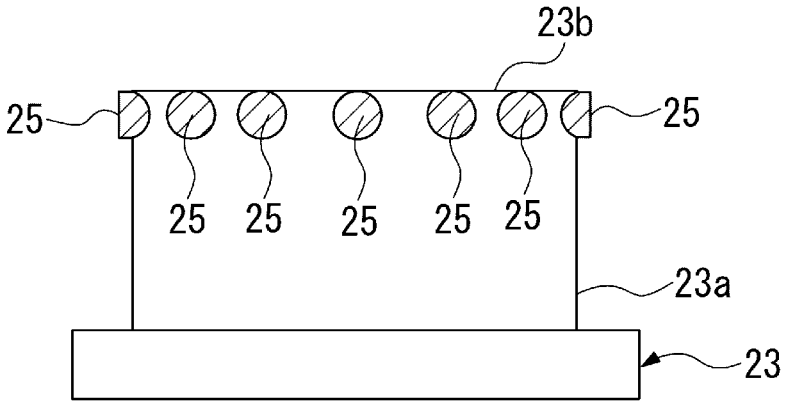

[FIG.6]
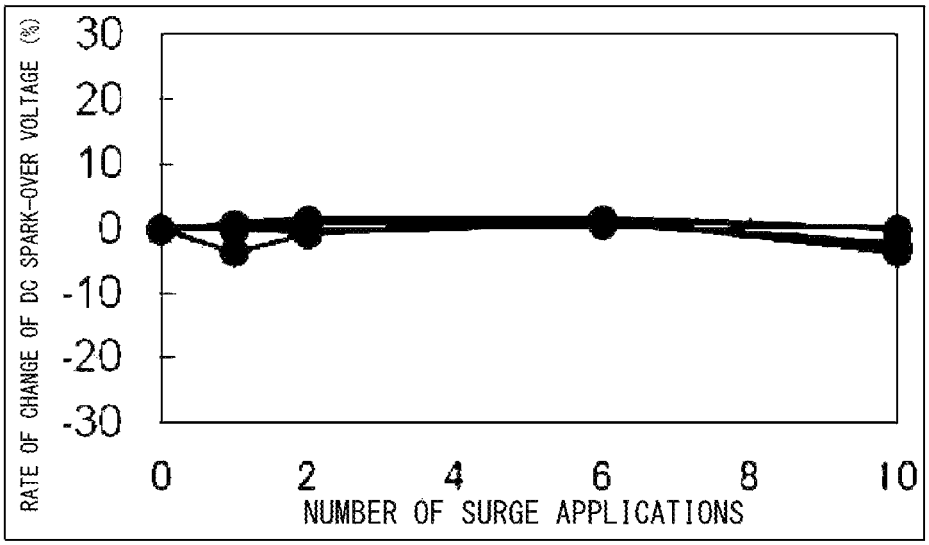
[FIG.7]
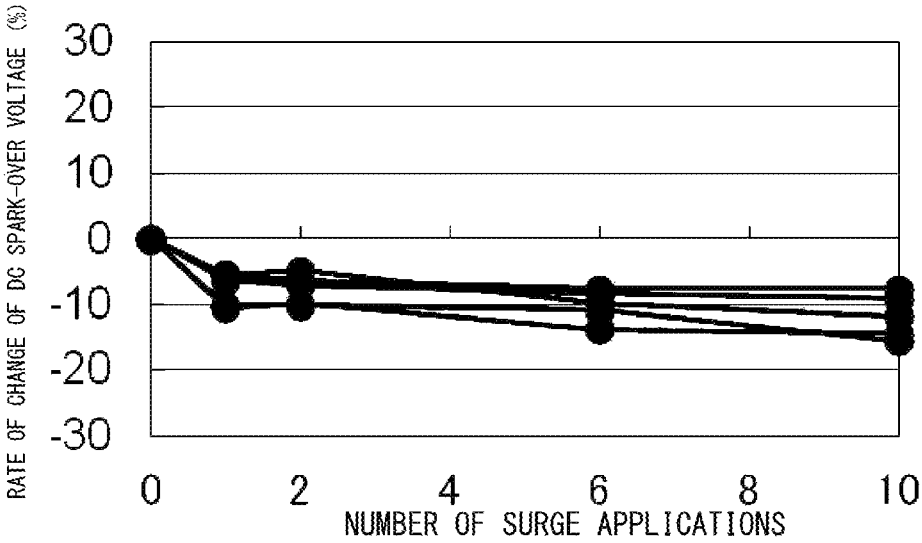

[FIG.8]
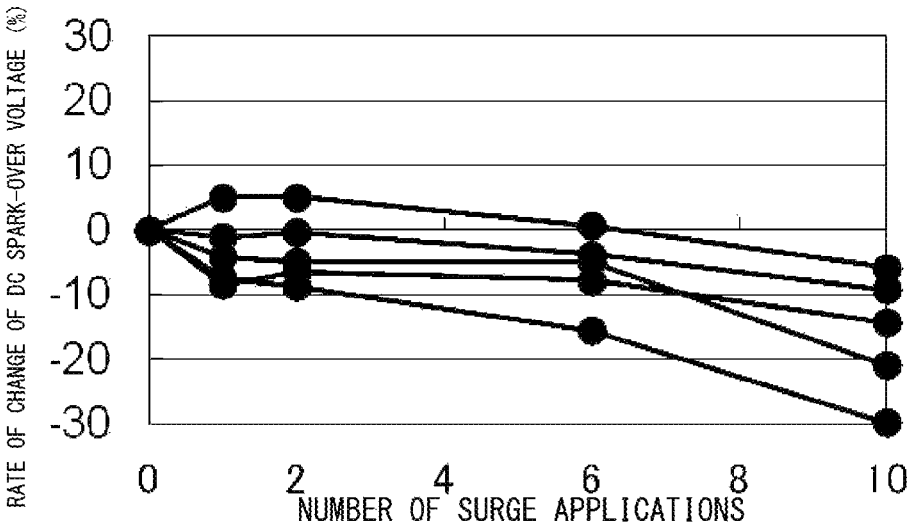
[FIG.9]
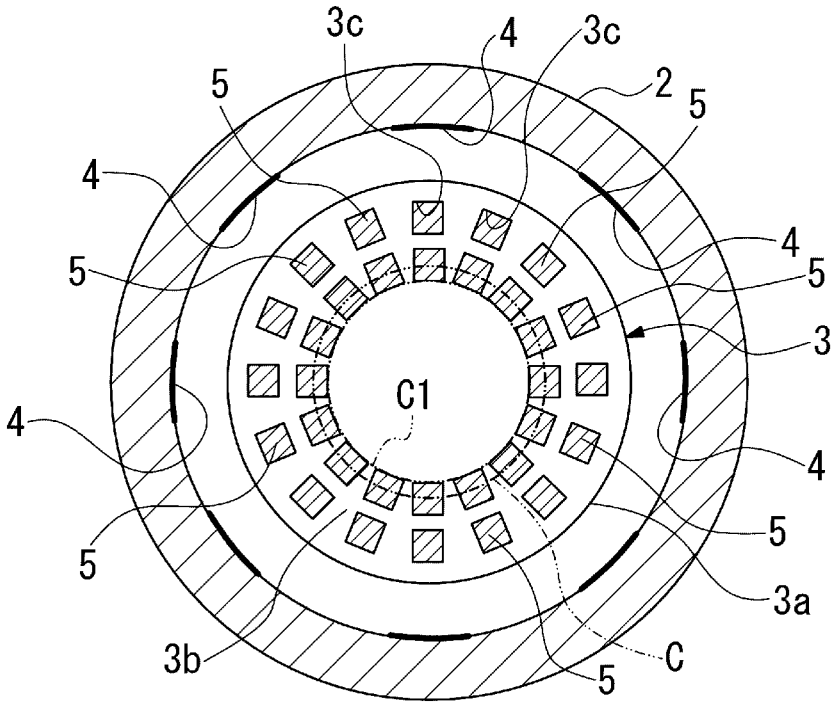

DISCHARGE TUBE HAVING DISCHARGE ACTIVE LAYER(S)

BACKGROUND OF THE INVENTION

Field of the Invention

The present invention relates to a discharge tube that is used, for example, as a surge absorber for protecting a wide variety of equipment from surges caused by a lightning strike or the like so as to prevent accidents, or as a switching spark gap for energizing spark plugs.

Description of the Related Art

Discharge tubes are adopted as, for example, a gas arrester, that is, a surge absorber for preventing electronic equipment and the like from being broken down due to the incoming of an overvoltage, such as for example, a lightning surge or an electrostatic surge, or as a switching spark gap for high pressure discharge lamps or spark plugs.

Such discharge tubes used as a lightning surge protective device or switching spark gap are required to have stability of operating voltage to repeated discharges and excellent withstand voltage characteristics. In order to attain such stability to repeated operations, excellent withstand voltage characteristics, and the like, forming a coating of a discharge-activated material (discharge active layer) on a surface of a discharge electrode has been investigated.

For example, Patent document 1 discloses a surge arrester wherein a depression is formed on the central part of the surface facing to a discharge electrode and a coating of an activated substance is formed in the depression. Patent document 2 discloses a discharge tube wherein a coating is formed on the entire surface facing to a discharge electrode, and a discharge tube wherein a plurality of coatings are formed on the central part of the surface facing to a discharge electrode. Patent document 3 discloses a discharge tube wherein a plurality of hemispherical or rectangular holes, in which coatings are formed, are arranged in the center of the apical surface of a discharge electrode and also arranged along two imaginary circles concentric with the inner wall surface of a cylindrical case member.

PRIOR ART DOCUMENTS

Patent Documents

[Patent Document 1] Japanese Patent No. 5707533

[Patent Document 2] Japanese Utility Model Registration No. 3125264

[Patent Document 3] Japanese Utility Model Registration No. 3140979

SUMMARY OF THE INVENTION

Problems to be Solved by the Invention

The following problems still remain in the conventional technologies described above.

Specifically, in the conventional technologies described above, a coating of a discharge-activated material for supporting discharge is formed on the central part of the apical surface of a discharge electrode. In this configuration, however, the distance between the coating and a discharge trigger film that is formed on the inner surface of an insulating hollow body increases, which may cause the operating voltage to be unstable. In particular, an arc discharge that is transited from a glow discharge generated at an initial discharge stage often occurs in the central part of a discharge electrode, which can cause a discharge active layer in the central part of the discharge electrode to be scattered and adhered to its surroundings. This can cause variation in the operating voltage with respect to repeated discharges.

In addition, as in the case of Patent document 1, when a plurality of coatings are arranged in the central part of the apical surface, the distance between the coatings and the discharge trigger film varies depending on the distance thereof from the axis of the discharge electrode. This can cause variation in the operating voltage and therefore the operating voltage can be unstable.

Furthermore, as in the case of Patent document 3, when the coatings are arranged along a plurality of concentric circles having different diameters, the distance between the coatings and the discharge trigger film varies depending on the diameters of the concentric circles. This can also cause variation in the operating voltage and therefore the operating voltage can be unstable.

The present invention has been made in view of the aforementioned circumstances, and an object of the present invention is to provide a discharge tube having improved stability of operating voltage to repeated discharges.

Means for Solving the Problems

The present invention adopts the following configurations in order to overcome the aforementioned problems. Specifically, a discharge tube according to a first aspect of the present invention comprises: a cylindrical insulating hollow body having openings at least at both ends and at least a pair of sealing electrodes facing to each other for closing the openings so as to seal a discharge control gas inside the body, wherein a discharge trigger film made of a conductive material is formed on the inner circumferential surface of the insulating hollow body, each of the sealing electrodes has a convex portion projecting into the insulating hollow body and a discharge active layer(s) that is/are made of a material having higher electron emission characteristics than that of the sealing electrodes and formed at the apical end of the convex portion, the discharge active layer(s) is/are formed at or near the outer periphery edge of the apical surface of the convex portion as a plurality of layers or a continuously extending single layer along the outer periphery edge, and the central part of the apical surface of the convex portion is a region where the discharge active layer is not formed.

In the discharge tube according to the first aspect of the present invention, since the discharge active layer(s) is/are formed at the apical end of the convex portion and near the outer periphery edge of the apical surface as a plurality of layers or a continuously extending single layer along the outer periphery edge, and since the central part of the apical surface of the convex portion is a region where the discharge active layer is not formed, the discharge active layer(s) can get close to the discharge trigger film. As a result, variation in the distance between the discharge active layer(s) and the discharge trigger film can be reduced and thus the operating voltage can be stable. In addition, since the central part of the apical surface of the convex portion is a region where the discharge active layer is not formed, the scatter of the discharge active layer(s) by an arc discharge generated in the central part of the apical surface can be decreased, and accordingly change in the operating voltage with respect to repeated discharges can be suppressed.

A discharge tube according to a second aspect of the present invention is characterized by the discharge tube according to the first aspect, wherein the insulating hollow body is cylindrical and the convex portion is columnar, and the discharge active layer(s) is/are formed at an equal distance from the axis of the convex portion.

Specifically, in this discharge tube, since the discharge active layer(s) is/are formed at an equal distance from the axis of the convex portion, the distance between the inner circumferential surface of the cylindrical insulating hollow body and each of the discharge active layers can be equal. As a result, variation in the distance between each of the discharge active layers and the discharge trigger film that is formed on the inner circumferential surface can be reduced.

A discharge tube according to a third aspect of the present invention is characterized by the discharge tube according to the first or second aspect, wherein the discharge active layer(s) is/are formed on the outer peripheral surface of the apical end of the convex portion.

Specifically, in this discharge tube, since the discharge active layer(s) is/are formed on the outer peripheral surface of the apical end of the convex portion, the distance between the discharge active layer(s) and the discharge trigger film can be further decreased, which can further reduce variation in the distance. In addition, since the discharge active layer(s) is/are not scatted by an arc discharge generated on the apical surface of the convex portion, change in the operating voltage with respect to repeated discharges can be further suppressed.

A discharge tube according to a fourth aspect of the present invention is characterized by the discharge tube according to any one of the first to third aspects, wherein the discharge active layer(s) include(s) Si and O as the main components together with at least one of Na, Cs, and C.

Effects of the Invention

According to the present invention, the following effects may be provided.

Specifically, according to the discharge tube of the present invention, since the discharge active layer(s) is/are formed at the apical end of the convex portion and near the outer periphery edge of the apical surface as a plurality of layers or a continuously extending single layer along the outer periphery edge, and since the central part of the apical surface of the convex portion is a region where the discharge active layer is not formed, variation in the distance between the discharge active layer(s) and the discharge trigger film can be reduced and the scatter of the discharge active layer(s) by an arc discharge generated in the central part of the apical surface can be decreased. As a result, change in the operating voltage with respect to repeated discharges can be suppressed, and thus the operating voltage can be stable.

BRIEF DESCRIPTION OF THE DRAWINGS

FIG. 1 is a cross-sectional view of a discharge tube according to a first embodiment of the present invention.

FIG. 2 is a cross-sectional view along line A-A in FIG. 1.

FIG. 3 is a cross-sectional view of a discharge tube according to a second embodiment of the present invention.

FIG. 4 is a cross-sectional view along line B-B in FIG. 3.

FIG. 5 is a side view of a sealing electrode in the second embodiment.

FIG. 6 is a graph showing the rate of change of DC spark-over voltage relative to the number of surge current applications in a discharge tube according to Example 1 of the present invention.

FIG. 7 is a graph showing the rate of change of DC spark-over voltage relative to the number of surge current applications in a discharge tube according to Example 2 of the present invention.

FIG. 8 is a graph showing the rate of change of DC spark-over voltage relative to the number of surge current applications in a discharge tube according to Comparative Example of the present invention.

FIG. 9 is a cross-sectional view of a discharge tube according to another embodiment of the present invention.

DESCRIPTION OF THE EMBODIMENTS

Hereinafter, a discharge tube according to a first embodiment of the present invention will be described with reference to FIGS. 1 and 2. In the drawings referenced in the following description, the scale of each component may be changed as appropriate so that each component is recognizable or is readily recognized.

As shown in FIGS. 1 and 2, a discharge tube 1 according to the present embodiment includes a cylindrical insulating hollow body 2 having openings at both ends and a pair of sealing electrodes 3 facing to each other for closing the openings so as to seal a discharge control gas inside the body.

A discharge trigger film 4 made of a conductive material is formed on the inner circumferential surface of the insulating hollow body 2.

Each of the sealing electrodes 3 has a convex portion 3*a* projecting into the insulating hollow body 2 and discharge active layers 5 that are made of a material having higher electron emission characteristics than that of the sealing electrodes 3 and formed at the apical end of the convex portion 3*a*.

The discharge active layers 5 are formed at the apical end of the convex portion 3*a* and near the outer periphery edge of the apical surface 3*b* as a plurality of layers along the outer periphery edge. In addition, the central part of the apical surface 3*b* of the convex portion 3*a* is a region where the discharge active layer 5 is not formed.

Note that each of the discharge active layers 5 are arranged along the concentric circle "C" from the axis of the convex portion 3*a*. These discharge active layers 5 are preferably arranged at positions away from the axis of the convex portion 3*a* by 50% or more of its radius, and more preferably by 60% or more of its radius. When the discharge active layers 5 are arranged at positions away from the axis of the convex portion 3*a* by less than 50% of its radius, the area of the central main discharge region becomes smaller, which may produce unstable discharges.

Furthermore, the discharge active layers 5 are formed in a plurality of concave portions 3*c* formed near the outer periphery edge of the apical surface 3*b* of the convex portion 3*a*.

The insulating hollow body 2 is cylindrical and the convex portion 3*a* is columnar, and the discharge active layers 5 are formed at an equal distance from the axis of the convex portion 3*a*.

The discharge active layers 5 include Si and O as the main components together with at least one of Na, Cs, and C.

The discharge trigger film 4 is made of carbon or the like.

The insulating hollow body 2 is a ceramic cylinder, such as for example, a cylindrical insulating tube made of alumina or the like. It is preferred that the insulating hollow body 2 is made of a crystalline ceramic such as alumina or the like.

The pair of sealing electrodes 3 are convex metal members made of copper, a copper alloy, a 42Ni alloy, or the like having the convex portions 3*a* projecting inwardly, with a discharge gap being formed between the convex portions 3*a* facing to each other.

In addition, these sealing electrodes 3 are joined to the insulating hollow body 2 so as to be sealed by a sealing material 6 such as a brazing material or the like.

The discharge control gases described above include He, Ne, Ar, Kr, Xe, $SF_6$, $N_2$, $CO_2$, $C_3F_8$, $C_2F_6$, $CF_4$, $H_2$, and a combination of these gases.

A method of manufacturing the discharge active layers 5 includes the steps of: adding a cesium carbonate powder to a sodium silicate solution to form a precursor, applying the precursor on surfaces of the sealing electrodes 3 (in the concave portions 3*c*), and subjecting the applied precursor to a heat treatment at a temperature or higher at which sodium silicate softens and at a temperature or higher cesium carbonate melts and decomposes.

This manufacturing method also includes a step of brazing the sealing electrodes 3 to the openings of the insulating hollow body 2 at a brazing temperature that is a temperature at which sodium silicate softens or higher and a temperature at which cesium carbonate melts or higher as in the heat treatment described above.

The precursor is prepared so as to have a predetermined composition by adding a cesium carbonate powder to a sodium silicate solution at a prescribed ratio. Specifically, a sodium silicate glass solution and a cesium carbonate powder are mixed to prepare a precursor for forming a viscous discharge active layer.

Next, the prepared precursor is coated on surfaces of the sealing electrodes 3 (in the concave portions 3*c*). For this step, various coating methods can be employed including known wet processes such as stamping, printing using a metal mask, a squeegee, or the like, dipping, screen printing, ink-jet coating, dispenser coating, spin-coating, and the like for applying various liquid materials on a desired place.

Next, the sealing electrodes 3, portions of the apical surfaces 3*b* of which are coated with the precursor, are brazed to the insulating hollow body 2 under a discharge control gas atmosphere. As a result, a discharge control gas is sealed inside the insulating hollow body 2. In this case, the brazing temperature is 820° C., for example. During this brazing step, a brazing material and cesium carbonate are melted to form the discharge active layers 5 at the predetermined positions on the apical surfaces 3*b* of the sealing electrodes 3.

As described above, in the discharge tube 1 of the present embodiment, since the discharge active layers 5 are formed at the apical end of the convex portion 3*a* and near the outer periphery edge of the apical surface 3*b* as a plurality of layers along the outer periphery edge, and since the central part of the apical surface 3*b* of the convex portion 3*a* is a region where the discharge active layer 5 is not formed, the discharge active layers 5 can get close to the discharge trigger film 4. As a result, variation in the distance between the discharge active layer(s) 5 and the discharge trigger film 4 can be reduced and thus the operating voltage can be stable.

In addition, since the central part of the apical surface 3*b* of the convex portion 3*a* is a region where the discharge active layer 5 is not formed, the scatter of the discharge active layers 5 by an arc discharge generated in the central part of the apical surface 3*b* can be decreased, and thus change in the operating voltage with respect to repeated discharges can be suppressed. That is, state change inside the discharge space can be reduced, and therefore a rapid change in the operating voltage can be suppressed.

Furthermore, since the discharge active layers 5 are formed at an equal distance from the axis of the convex portion 3*a*, the distance between the inner circumferential surface of the cylindrical insulating hollow body 2 and each of the discharge active layers 5 becomes equal. As a result, variation in the distance between the discharge active layers 5 and the discharge trigger film 4 that is formed on the inner circumferential surface can be reduced, and thus the discharge tube according to the present embodiment having higher discharge characteristics and stability of operating voltage can be provided.

Next, a discharge tube according to a second embodiment of the present invention will be described below with reference to FIGS. 3 to 5. Note that, in the following description of the second embodiment, the same components as those in the first embodiment described above are denoted by the same reference numerals, and thus the description thereof is omitted.

The second embodiment is different from the first embodiment in the following points. In the first embodiment, the discharge active layers 5 are formed on the apical surface 3*b* of the convex portion 3*a*, whereas in a discharge tube 21 of the second embodiment as shown in FIGS. 3 to 5, discharge active layers 25 of a sealing electrode 23 are formed on the outer peripheral surface of the apical end of a convex portion 23*a*. Specifically, in the second embodiment, the plurality of discharge active layers 25 are arranged near the outer periphery edge of an apical surface 23*b* of the convex portion 23*a* and on the outer peripheral surface of the convex portion 23*a* at equal intervals along the outer periphery edge.

In addition, each of the discharge active layers 5 is formed into a rectangular shape in the first embodiment, whereas each of the discharge active layers 25 is formed into a circular shape in the second embodiment.

Thus, in the discharge tube 21 of the second embodiment, since the discharge active layers 25 are formed on the outer peripheral surface of the apical end of the convex portion 23*a*, the distance between the discharge active layer(s) and the discharge trigger film 4 can be further decreased, and thus variation in the distance can be further reduced. In addition, since the discharge active layers 25 are not scattered by an arc discharge generated on the apical surface 23*b* of the convex portion 23*a*, change in the operating voltage with respect to repeated discharges can be further suppressed.

Examples

Next, the electric properties (discharge characteristics) of gas arresters (discharge tubes) according to Examples of the present invention in which discharge active layers are formed on a surface of a sealing electrode will be described with reference to FIGS. 6 to 8.

The samples according to Examples 1 and 2 of the present invention were fabricated employing the discharge tubes according to the first and second embodiments described above, respectively.

Note that the samples for evaluating the electric properties were fabricated using insulating hollow bodies and sealing electrodes having the same dimensions, as well as the same discharge control gas to be filled inside the gas arresters, the same gas pressure, and the same gas sealing process. Furthermore, the DC spark-over voltage for each sample was fixed to 350 V. That is, all factors except the positions of the discharge active layers were the same.

This evaluation test on the electric properties, which is for evaluating surge current capacity characteristics, was performed to compare the performance that is an important factor for a discharge tube used as a lightning surge protective device. For this test, a surge current having a lightning surge waveform of 8/20 μs and a peak value of 7500 A was repeatedly applied to each sample, followed by determination on whether the initial DC spark-over voltage characteristics of each sample was still maintained.

As a Comparative Example, the surge current capacity characteristics of a gas arrester (discharge tube) in which a discharge active layer was formed only on the central part of the convex portion were also evaluated.

In the Comparative Example as shown in FIG. 8, when a surge current of 7500 A was repeatedly applied to the sample, the DC spark-over voltages were remarkably changed from the initial values, along with large variation in the DC spark-over voltage. The tenth application of a surge current caused the maximum rate of change of about 30%. On the other hand, in Examples 1 and 2 of the present invention as shown in FIGS. 6 and 7, after a surge current was repeatedly applied, the change in the DC spark-over voltage was small compared to that in the Comparative Example, along with small variation in the DC spark-over voltage. The maximum rate of change was as low as about 15%. Thus, the discharge tube according to each Example of the present invention exhibited relatively stable discharge characteristics, indicating high durability.

The technical scope of the present invention is not limited to the aforementioned embodiments and Examples, but the present invention may be modified in various ways without departing from the scope or teaching of the present invention.

For example, in each embodiment described above, although the discharge active layers are formed as a plurality of layers having a rectangular or circular shape, the discharge active layer(s) may be formed so as to extend as a continuously extending single layer in a line or belt-like shape on the predetermined regions described above.

Furthermore, in another embodiment as shown in, for example, FIG. 9, the concave portions 3*c* formed with the discharge active layers 5 may be radially arranged at positions away from the axis of the convex portion 3*a* by 50% or more of its radius. In FIG. 9, a circle "C1" is indicated with a chain double-dashed line at positions away from the axis of the convex portion 3*a* by 50% of its radius.

REFERENCE NUMERALS

1, 21: discharge tube, 2: insulating hollow body, 3, 23: sealing electrode, 3*a*, 23*a*: convex portion, 3*b*, 23*b*: apical surface of convex portion, 4: discharge trigger film, 5, 25: discharge active layer

What is claimed is:

1. A discharge tube comprising:

a cylindrical insulating hollow body having openings at least at both ends; and at least a pair of sealing electrodes facing to each other for closing the openings so as to seal a discharge control gas inside the body, wherein a discharge trigger film made of a conductive material is formed on the inner circumferential surface of the insulating hollow body, each of the sealing electrodes has a convex portion projecting into the insulating hollow body and a discharge active layer(s) that is/are made of a material having higher electron emission characteristics than that of the sealing electrodes and formed at an apical end of the convex portion, the discharge active layer(s) is/are formed only on an outer peripheral surface of the apical end of the convex portion and near an outer periphery edge of an apical surface as a plurality of layers or a continuously extending single layer along the outer periphery edge, and the central part of the apical surface of the convex portion is a region where the discharge active layer is not formed.

2. The discharge tube according to claim 1, wherein the insulating hollow body is cylindrical and the convex portion is columnar, and the discharge active layer(s) is/are formed at an equal distance from the axis of the convex portion.

3. The discharge tube according to claim 1, wherein the discharge active layer(s) include(s) Si and O as the main components together with at least one of Na, Cs, and C.

* * * * *